US010793239B2

(12) United States Patent
Caprice et al.

(10) Patent No.: US 10,793,239 B2
(45) Date of Patent: Oct. 6, 2020

(54) DIVING MASK HAVING A BUILT-IN SNORKEL

(71) Applicant: DECATHLON, Villeneuve d'Ascq (FR)

(72) Inventors: Cédric Caprice, Biarritz (FR); Raphaël Girault, Cestas (FR); Gabriele Cucchia, Genoa (IT)

(73) Assignee: DECATHLON, Villeneuve d'Ascq (FR)

( * ) Notice: Subject to any disclaimer, the term of this patent is extended or adjusted under 35 U.S.C. 154(b) by 1117 days.

(21) Appl. No.: 15/185,061

(22) Filed: Jun. 17, 2016

(65) Prior Publication Data

US 2016/0297505 A1 Oct. 13, 2016

Related U.S. Application Data

(63) Continuation of application No. PCT/FR2014/051056, filed on May 5, 2014.

(51) Int. Cl.
*B63C 11/16* (2006.01)
*B63C 11/12* (2006.01)

(52) U.S. Cl.
CPC ..... *B63C 11/16* (2013.01); *B63C 2011/128* (2013.01); *B63C 2011/165* (2013.01)

(58) Field of Classification Search
CPC ... B63C 2011/165; B63C 11/12; B63C 11/16; B63C 11/20; B63C 11/205;
(Continued)

(56) References Cited

U.S. PATENT DOCUMENTS 2,897,817 A * 8/1959 Marina ..... B63C 11/14 128/205.17
3,137,295 A * 6/1964 Stansfield ..... A61F 9/06 128/206.24

(Continued)

FOREIGN PATENT DOCUMENTS

CN 1498818 A 5/2004
CN 101020497 A 8/2007

(Continued)

OTHER PUBLICATIONS

English-language translation and French International Preliminary Report on Patentability issued in corresponding International App. No. PCT/FR2014/051056, completed May 31, 2016 (9 pages).

*Primary Examiner* — Michael J Tsai
(74) *Attorney, Agent, or Firm* — Bookoff McAndrews, PLLC

(57) ABSTRACT

A diving mask includes a faceplate secured to a frame, a flexible skirt having a partition delimiting an upper viewing chamber from a lower breathing chamber, a snorkel having an inlet channel for inhaled air and at least one escape channel for exhaled air, the snorkel being a continuation of the upper part of the frame, the inlet channel for inhaled air leading into the upper chamber, whilst the first escape channel for exhaled air communicates with the lower chamber. The frame is rigid and inside the frame there is arranged at least one first inner duct for exhaled air having an upper end leading into the escape channel for exhaled air, and a lower end in fluid communication with the lower chamber.

28 Claims, 9 Drawing Sheets

(58) Field of Classification Search
CPC ..... B63C 11/207; B63C 11/22; A62B 18/00; A62B 18/02; A62B 18/025; A62B 18/04; A62B 18/08; A62B 18/082; A61M 16/0616
See application file for complete search history.

(56) References Cited

U.S. PATENT DOCUMENTS

| | | | | | |
|---|---|---|---|---|---|
| 5,199,421 | A | | 4/1993 | Figgiani et al. | |
| 5,410,757 | A | * | 5/1995 | Vienamo | A61F 9/028 128/201.23 |
| 5,960,791 | A | * | 10/1999 | Winefordner | B63C 11/205 128/201.11 |
| 8,887,728 | B2 | * | 11/2014 | Boussignac | A61M 16/06 128/206.24 |
| 2001/0013346 | A1 | * | 8/2001 | Lemke | B63C 11/16 128/201.11 |
| 2008/0047552 | A1 | * | 2/2008 | McCarthy | B63C 11/205 128/201.11 |
| 2009/0172935 | A1 | | 7/2009 | Anderson et al. | |
| 2013/0074835 | A1 | | 3/2013 | Newhouse | |

FOREIGN PATENT DOCUMENTS

| | | | | | |
|---|---|---|---|---|---|
| CN | 201217499 | Y | | 4/2009 | |
| CN | 202186505 | U | | 4/2012 | |
| CN | 202896857 | U | | 4/2013 | |
| CN | 204548450 | U | | 8/2015 | |
| CN | 205469729 | | * | 5/2016 | B63C 11/16 |
| CN | 205469729 | U | | 8/2016 | |
| CN | 205589443 | U | | 9/2016 | |
| CN | 206141801 | | * | 5/2017 | B63C 11/16 |
| DE | 102015107175 | A1 | | 11/2016 | |
| FR | 2720050 | A1 | | 11/1995 | |
| GB | 2498753 | | * | 7/2013 | B63C 11/16 |
| WO | WO98/03225 | | * | 1/1998 | A62B 7/00 |

* cited by examiner

DIVING MASK HAVING A BUILT-IN SNORKEL

RELATED APPLICATIONS

This application is a continuation of International Application PCT/FR2014/051056, with an international filing date of May 5, 2014, the entire contents of which are herein incorporated by reference.

BACKGROUND

The present disclosure concerns the field of diving masks and in particular the masks used for <<snorkeling>>.

Snorkeling allows observation of marine life whilst swimming on the surface of the water. A snorkeler must therefore be able to hold the head under water whilst breathing.

In general, snorkelers are equipped with a mask for viewing and a snorkel for breathing. A snorkel is a tube whose lower end is equipped with a mouthpiece which fits into the user's mouth, and an upper end which allows both the entry of fresh air and the escaping of exhaled air.

It is known that such equipment has numerous disadvantages. First, since breathing via the mouth is not natural, some persons have difficulty breathing orally through a snorkel. Another disadvantage is that it is not possible to talk underwater when wearing a snorkel.

A further disadvantage, related to the use of the mask, is that the inner wall of the faceplate generally tends to fog up which is detrimental to good visibility and compels the user to clean the mask regularly. The onset of fogging is due to the fact that the user's nose opens into the viewing chamber located between the faceplate and the user's eyes.

The use of this mask-snorkel device is therefore not very comfortable.

To overcome this drawback, document FR 2 720 050 proposes a diving mask with which it is possible to breathe through the nose and through the mouth.

For this purpose the diving mask comprises:

a frame having an upper part;

a faceplate secured to the frame;

a flexible skirt secured to the frame, the skirt comprising a partition delimiting an upper chamber for viewing and a lower chamber for breathing, the partition being arranged such that it bears upon the top of the user's nose so that the user's mouth and nose are positioned in the lower chamber, whilst the user's eyes are positioned in the upper chamber, the partition comprising at least one passageway arranged to allow circulation of inhaled air directed from the upper chamber towards the lower chamber during an inhalation phase by the user;

a snorkel having an inlet channel for inhaled air and at least a first escape channel for exhaled air, the said snorkel being in the continuation of the upper part of the frame, the inlet channel for inhaled air leading into the upper chamber, whilst the first escape channel for exhaled air communicates with the lower chamber.

According to this document, the exhaled air circulates in the skirt formed of a flexible hollow seal adhering between the mask and the face.

Said mask has a drawback however. If the user over-tightens the mask attaching system, the hollow flexible seal is squeezed against the face which will cause obstruction of the duct through which exhaled air flows. On the other hand, if the user does not sufficiently tighten the attaching system there will no longer be a perfect seal between the face and skirt failing which there is a risk that water might enter inside the lower or upper chambers, this being undesirable.

SUMMARY

It is one objective of the disclosure to propose a diving mask which in particular overcomes the aforementioned disadvantages.

Embodiments of the disclosure achieve this objective through the fact that:

the frame is rigid, and inside the frame there is arranged at least one first inner duct for exhaled air, the said first inner duct having an upper end leading into the escape channel for exhaled air, and a lower end in fluid communication with the lower chamber.

Since the frame is rigid it will be understood that the first inner duct cannot be squeezed, unlike the hollow seal in the prior art. In addition, since the coupling sleeve projects from the first side edge of the flexible skirt there is no risk that it will be squashed if the attaching system is drawn very tight.

The frame therefore has a dual function, namely to support the faceplate and to form air circulation means.

The connection between the frame and the flexible skirt may be obtained via a flexible junction between the flexible skirt and the lower end of the first inner duct.

The frame may comprise an upper portion and a lower portion assembled onto the upper portion, and the first inner duct is arranged in the upper portion. Further, the first inner duct may open into the lower end of the upper portion.

The flexible skirt may further comprise at least one first coupling sleeve projecting from a first side edge of the flexible skirt and extending towards the upper part of the mask, the first coupling sleeve having a lower end leading into the lower chamber and an upper end, opposite the lower end, in fluid connection with the lower end of the first inner duct.

The flexible skirt may be made in silicone whilst the frame may be made of rigid plastic such as polypropylene or polycarbonate.

The frame comprises a least one first lateral connector engaged in the second end of the first coupling sleeve.

The first lateral connector may extend towards the lower part of the mask. This first lateral connector may be curved towards the inside of the mask.

Further, the second end of the first coupling sleeve may have a bottom cross-section smaller than the cross-section of the first lateral connector. One advantage is to improve the seal between the second end of the first coupling sleeve and the first lateral connector.

The second end of the first coupling sleeve may lie flush with one side of the frame which makes it possible to obtain a frame having a smooth side. By means of this arrangement, the coupling sleeve has no catch point and there is therefore no risk that it might be inadvertently uncoupled from the first lateral connector.

According to embodiments of the disclosure, the first lateral connector comprises at least one rib on its outer surface, the said rib cooperating with the inner surface of the second end of the first coupling sleeve. The second end of the first coupling sleeve becomes deformed in contact with the rib. This allows an improvement in the seal between the first coupling sleeve and the first lateral connector, whilst improving the anchoring of the first coupling sleeve onto the first lateral connector.

The frame may comprise an upper portion and a lower portion, the first inner duct is arranged in the upper portion of the frame, the first inner conduit extends between the top of the frame and a lower end of the upper portion of the frame, and the first lateral connector projects from the lower end of the upper portion.

According to embodiments of the disclosure, the lower portion of the frame has an upper end assembled onto the lower end of the upper portion. In this embodiment, the frame is formed of at least two parts, namely the upper portion forming an upper rim surrounding the upper periphery of the flexible skirt, and the lower portion formed of one or more elements forming a lower rim surrounding the lower periphery of the flexible skirt.

Said arrangement is advantageous since it allows a mask to be manufactured using a minimum number of parts.

The upper portion, forming an upper rim, may be moulded in a single part.

According to one variant, the lower portion and the upper portion form one and the same part.

According to one embodiment, the flexible skirt is attached to the upper and lower portions of the frame.

The skirt may comprise a peripheral sealing lip arranged to bear against the user's face, and the first coupling sleeve flanks the said peripheral sealing lip.

Therefore the first coupling sleeve extends outside the flexible skirt moving up towards the upper part of the mask. This makes it possible to prevent squeezing of the first coupling sleeve and hence avoids obstruction thereof, whilst promoting the flow of exhaled air towards the upper portion of the frame thereby aiding the evacuation of spent air.

The partition may form one and the same part with the flexible skirt. The flexible skirt is therefore in a single piece, on the understanding that the first coupling sleeve forms one and the same part with the flexible skirt.

The flexible skirt may comprise a top coupling sleeve cooperating with a top connector of the frame into which there opens the inlet channel of the snorkel for inhaled air, the said top coupling sleeve leading into the upper chamber.

The top coupling sleeve may form one and the same part with the flexible skirt. Further, the top coupling sleeve may be arranged between the peripheral lip and the upper portion of the frame.

The top connector may project from an upper portion of the frame, whist the second coupling sleeve projects from an upper edge of the flexible skirt, the top connector engaging inside the top coupling sleeve.

The cross-section of the top coupling sleeve may be slightly smaller than the cross-section of the top connector to ensure a seal between the two elements. Further, the top connector may comprise at least one rib projecting from its outer surface, the said rib cooperating with an inner wall of the coupling sleeve to further improve the seal between the two elements connected to one another.

According to one embodiment of the disclosure the snorkel may also comprise a second outlet channel for exhaled air, and the frame may also comprise a second inner duct for exhaled air which has an upper end leading into the second channel for exhaled air and a lower end in fluid communication with the lower chamber.

The mask of the disclosure therefore has two independent circuits for exhaled air. Said arrangement has several advantages. First it facilitates breathing notably by allowing spent air to be expelled more quickly, which is particularly necessary when muscular effort is required e.g. for faster swimming. Secondly, the snorkeler is able to continue breathing even if one of the exhaled air circuits e.g. the first inner duct should become clogged.

The flexible skirt may comprise a second coupling sleeve projecting from a second side edge of the skirt, opposite the first side edge, the said second coupling sleeve having a lower end leading into the lower chamber and an upper end, opposite the lower end, in fluid communication with the lower end of the second inner duct.

The snorkel may have an upper part provided with an air-permeable cage, the snorkel further comprising a float that is mobile in said cage, the said float having an upper end provided with a shut-off device, the said float being arranged so that when the snorkel is submerged in the water the float is caused to move so that the shut-off device closes the entry to the snorkel.

The float may be a hollow element containing a volume of air, whilst the shut-off device is formed of a flexible diaphragm. Further, the float may comprise a body in which the flexible diaphragm is press-fitted thus imparting very good robustness to the float.

The air-permeable cage may be formed by an upper portion of the snorkel in which slits are provided.

The cage, in its lower part, may comprise holes to evacuate water which might enter therein.

The cage may be arranged on a sidewall of the upper part of the snorkel body in which there extend the inlet and outlet channels.

The snorkel may also comprise a plate having:

a main orifice communicating with the snorkel intake;

an inlet orifice communicating with the inlet of the inlet channel for inhaled air;

at least one first outlet orifice communicating with the outlet of the first escape channel;

a first check valve arranged to close the inlet orifice during an exhalation phase;

a second check valve arranged to close the first outlet orifice during an inhalation phase;

the snorkel further comprising a fluid communication chamber; the main orifice, the inlet orifice and the first outlet orifice leading therein.

It will be understood that the shut-off device is configured to close the main orifice when the snorkel is submerged in water. For this purpose the submerged float, undergoing Archimedes' thrust, is caused to move until the shut-off device, for example a flexible diaphragm, closes the main orifice. In this case, the snorkel intake is closed. There is therefore no risk that the user will inhale water. However the user can exhale since the flow of exhaled air can counteract Archimedes' thrust acting on the float.

When the snorkel is out of the water, and during an inhalation phase, fresh air enters into the fluid communication chamber via the main orifice when the float, in bottom position due to the use of gravity, does not block the snorkel intake. The second check valve is closed whilst the first valve allows fresh air to pass from the fluid communication chamber through the inlet orifice, the fresh air then successively flowing in the inlet channel for inhaled air, in the upper chamber via the top connector and the top coupling sleeve, then into the lower chamber where it is inhaled by the user. It is specified that the check valve of the partition allows inhaled air to pass through the partition.

When the snorkel is out of the water, and during an exhalation phase, the air exhaled by the user in the lower chamber successively flows in the first coupling sleeve (and in the second coupling sleeve if any), then in the first inner duct (and in the second inner duct if any), then in the first escape channel for exhaled air (and in the second escape channel for exhaled air if any). The exhaled air then flows into the fluid communication chamber via the first outlet orifice after which it leaves the fluid communication chamber via the main orifice. The spent air then escapes to outside the snorkel.

The snorkel may comprise a body having an upper end, the inlet channel for inhaled air and the first escape channel for exhaled air extending within the body, and the fluid communication chamber is arranged in a cap sealingly attached to the upper end of the body.

According to embodiments of the disclosure, the snorkel is removable or can be tilted. This is useful when the mask is not being used.

The mask of the disclosure may also comprise an elastic retaining strap which extends between an upper portion of the frame and a lower portion of the frame.

The elastic strap may comprise at least one link point with one or other of the lower or upper portions of the frame, the said link point being formed by the cooperation between one bulged end of the elastic strap and a slot formed in the lower or upper portion of the frame.

One advantage is to facilitate the mounting operation of the elastic strap and the holding in place thereof in relation to the frame.

The slot may be formed by a loop attached to the frame.

Further, the elastic strap may comprise two upper link points with the upper portion of the frame, and two lower link points with the lower portion of the frame.

The elastic strap is therefore X-shaped making it possible to cover ten rear part of the user's head, thereby providing stable maintaining of the mask on the user's head.

In addition, the upper portion of the frame may have a triple function; namely supporting the faceplate, forming means for the flow of exhaled and inhaled air, and allowing attachment of the elastic strap.

The diving mask of the disclosure also comprises a purge valve arranged in the breathing chamber to evacuate liquid to outside the mask. By means of sharp exhalation, any water which may be contained in the lower chamber will be expelled to outside the mask via the purge valve.

According to some embodiments, for example, so that the mask is more comfortable to wear, the partition may comprise a fold forming a lip intended to come into contact with the user's nose.

The passageway in the partition comprises a check valve arranged to allow circulation of inhaled air directed solely from the upper chamber towards the lower chamber during an inhalation phase by the user.

By means of the check valve, the flow of exhaled air does not rise back into the upper chamber, thereby improving the efficacy of the anti-fogging system of the mask.

BRIEF DESCRIPTION OF THE DRAWINGS

The disclosure will be better understood on reading the following description of one embodiment of the disclosure given as a non-limiting example with reference to the appended drawings in which.

DETAILED DESCRIPTION

Figure 1:
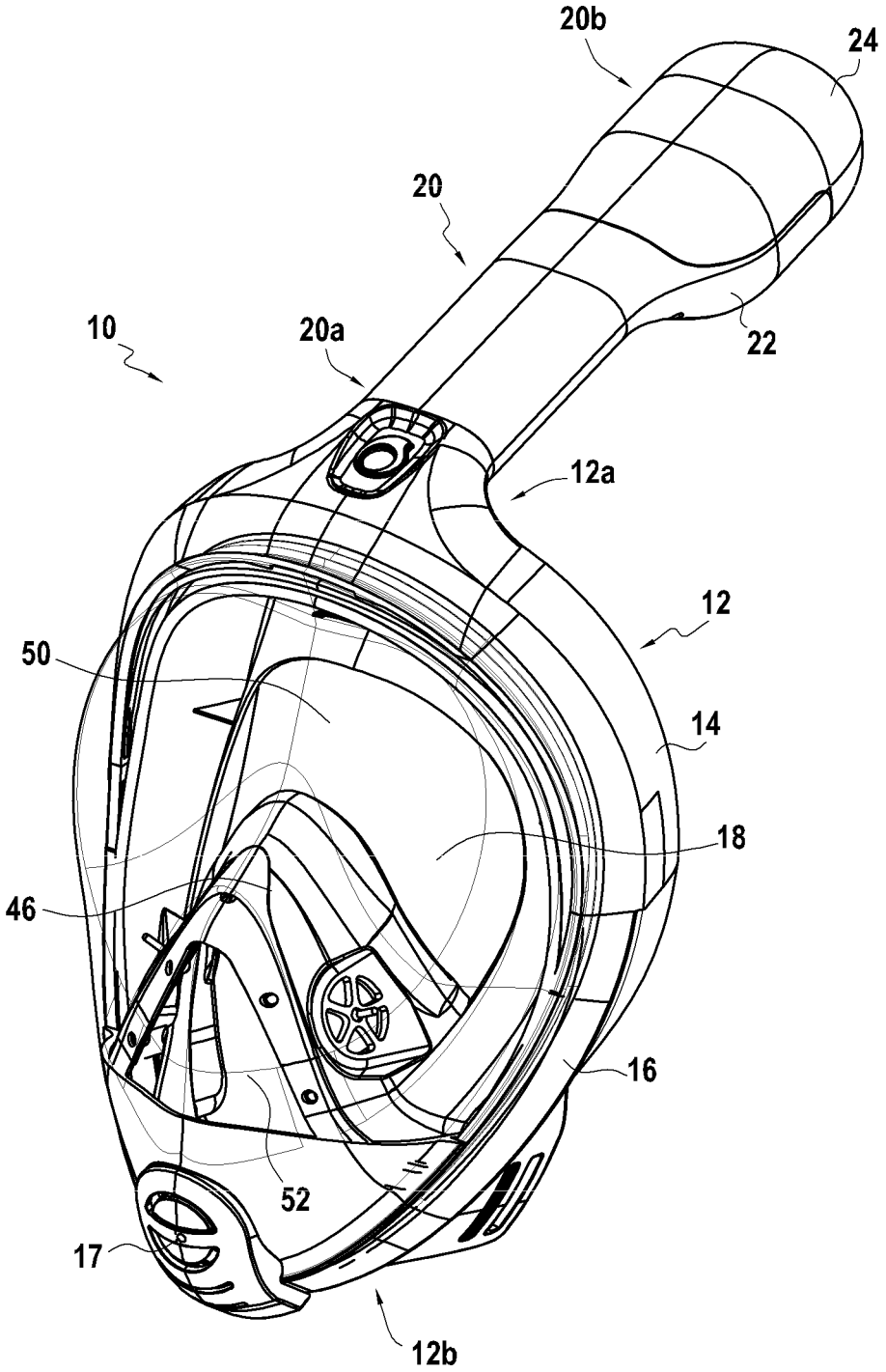
FIG. 1 is a perspective view of a diving mask of the disclosure.

FIG. 1 gives an example of embodiment of a diving mask 10 conforming to embodiments of the present disclosure. The diving mask 10 comprises a frame 12 of general oblong shape having an upper part 12*a* and a lower part 12*b*.

In this example the frame 12 comprises an upper portion 14 forming an upper rim and a lower portion 16 forming a lower rim.

The upper 14 and lower 16 portions of the frame are secured to one another to form a rim surrounding the user's face.

The diving mask 10 also comprises a faceplate 18 which is secured to the frame 12. In this example, the faceplate 18 is made in a hard, transparent plastic material.

As will be understood with the help of FIG. 1, the frame 12 surrounds the faceplate 18. This mask also comprises a purge valve 17 to evacuate any water which may enter inside the mask.

Figure 2:
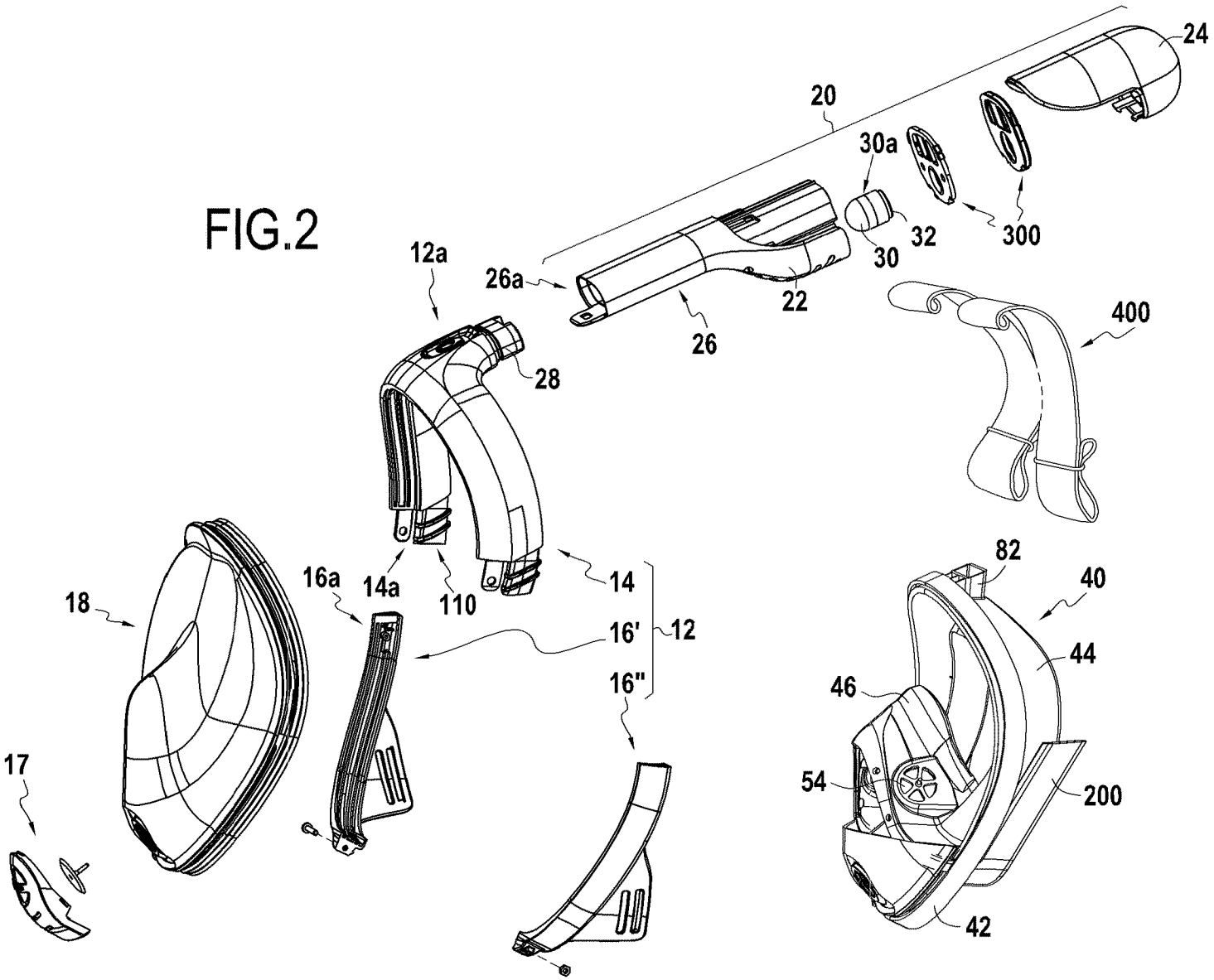
FIG. 2 is an exploded view of the diving mask in FIG. 1.

In addition, the diving mask 10 comprises a snorkel 20 which has a lower part 20*a* connected to the upper part 12*a* of the frame. In this example, the snorkel 20 is removable. It can be unclipped from the frame 12, making the mask more compact when not in use. The snorkel 20, more clearly seen in FIG. 2, also has an upper part 20*b* that is provided with an air-permeable cage 22.

As will be described in more detail below the snorkel 20 also comprises a cap 24 which cooperates with the cage 22.

With reference now to the exploded view, it can be seen that the lower portion 16 of the frame 12 comprises a first element 16' and a second element 16" which are attached to one another to form the lower portion.

It can also be seen that the snorkel 20 comprises an elongate body 26 whose lower end 26*a* press fits into an extension 28 of the upper portion 14 of the frame 12 which projects from the upper end 12*a* of the frame.

In addition, the snorkel 20 comprises a float 30 which is mobile inside the cage 22, the float having an upper end 30*a* provided with a shut-off device 32. As is described in detail below, the float 30 is arranged so that the when the snorkel 20 is submerged in the water, the float is caused to move so that the shut-off device 32, here a flexible diaphragm, closes the snorkel intake.

Figure 3:
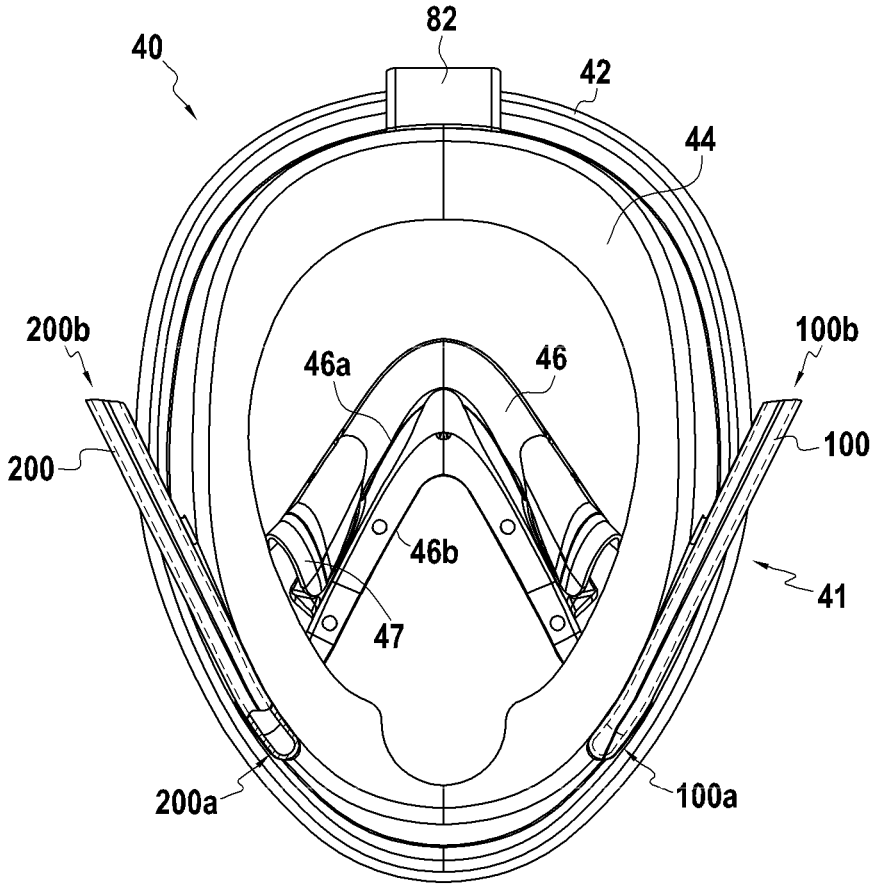
FIG. 3 is a rear view of the flexible skirt of the mask in FIG. 1.
Figure 4:
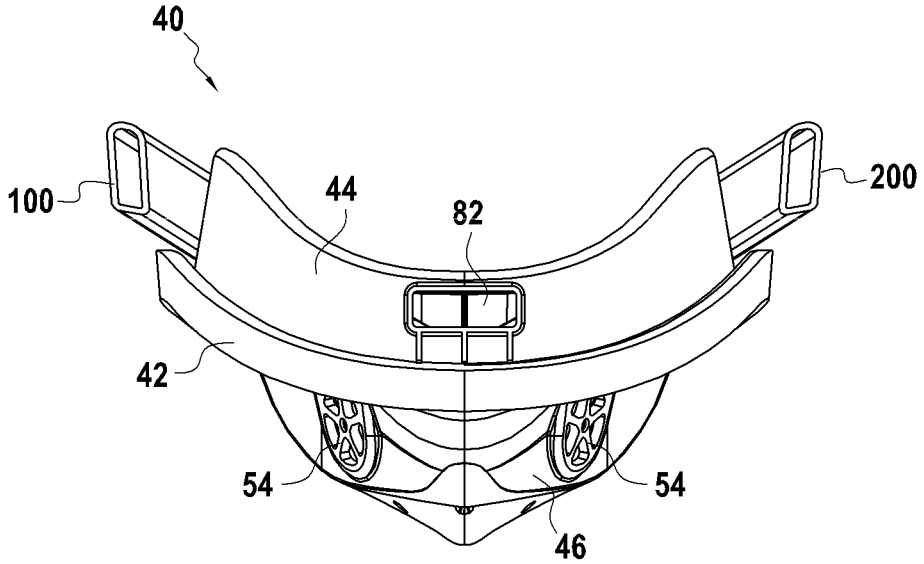
FIG. 4 is an overhead view of the flexible skirt in FIG. 3.
Figure 5:
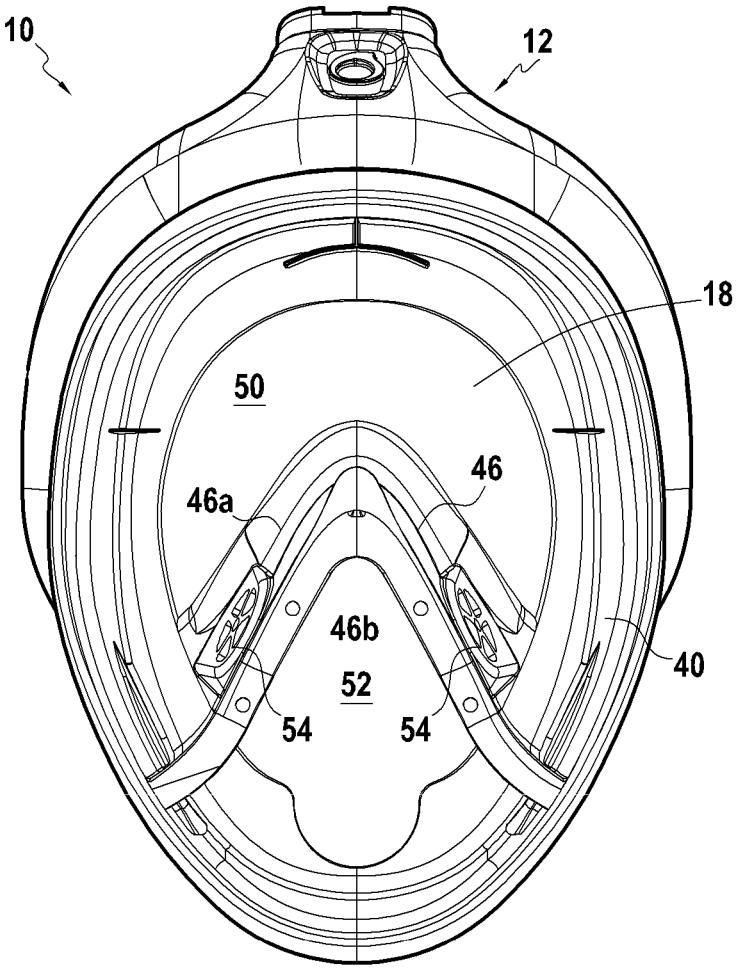
FIG. 5 is a front view of the flexible skirt assembled onto the frame.

With reference to FIGS. 3, 4 and 5, it can be seen that the flexible skirt 40 is of general oblong shape substantially having the same dimensions as the frame 12 and faceplate 18. The flexible skirt 40 is arranged between the faceplate 18 and the frame 14.

More specifically, the flexible skirt comprises a periphery 42 which has an upper part attached with the lower portion of the frame.

The flexible skirt 40 further comprises a peripheral sealing lip 44 arranged to bear against the user's face, so as to prevent water from entering between the user's face and the faceplate.

The flexible skirt 40 also comprises a partition 46 arranged to bear upon the top of the user's nose. This partition 46 therefore delimits an upper chamber 50 for viewing, from a lower chamber 52 for breathing. As will be understood with reference to FIG. 5, which illustrates the frame 12 assembled with the faceplate 18 and skirt 40, the user's mouth and nose are positioned in the lower chamber 52, whilst the user's eyes are positioned in the upper chamber 50.

In other words, the upper chamber 50 is delimited by the faceplate, the user's eyes, the upper wall 46*a* of the partition 46, and that part of the flexible skirt extending above the partition 46.

The lower chamber 52 is delimited by the faceplate 18, the user's mouth and nose, the lower part 46*b* of the partition 46, and by that part of the flexible skirt extending below the partition 46.

In this example, the partition comprises a pair of passageways provided with check valves 54 arranged to allow circulation of inhaled air directed solely from the upper chamber 50 towards the lower chamber 52 during an inhalation phase by the user. In this example, the flexible skirt is made in silicone and forms one and the same part with the partition 46, the sealing lip 44 and the periphery 42.

Figure 6:
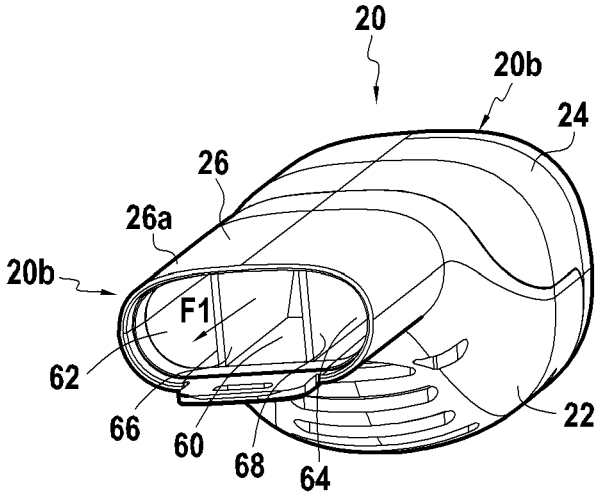
FIG. 6 illustrates the snorkel of the mask in FIG. 1, as seen from its lower end.

FIG. 6 illustrates the snorkel 20 as seen from its lower portion 20*a*.

It can be seen that the snorkel 20 comprises an inlet channel for inhaled air 60 which extends between the lower end 20*a* of the snorkel and the upper end 20*b* of the snorkel. This inlet channel for inhaled air therefore extends in a longitudinal direction of the body 26. As will be explained in more detail below, the inlet channel for inhaled air leads into the upper chamber.

The snorkel 20 further comprises a first escape channel for exhaled air 62, which also extends in the longitudinal direction of the body 26 between the lower part 20*a* and the upper part 20*b* of the snorkel 20. This first escape channel for exhaled air 62 communicates with the lower chamber 52.

In this example, the snorkel 20 comprises a second escape channel for exhaled air 64 similar to the first channel for exhaled air.

As seen in FIG. 6, the inlet channel for inhaled air 60 is separated from the first and second escape channels for exhaled air 62, 64 via two longitudinal walls 66, 68.

Figure 7:
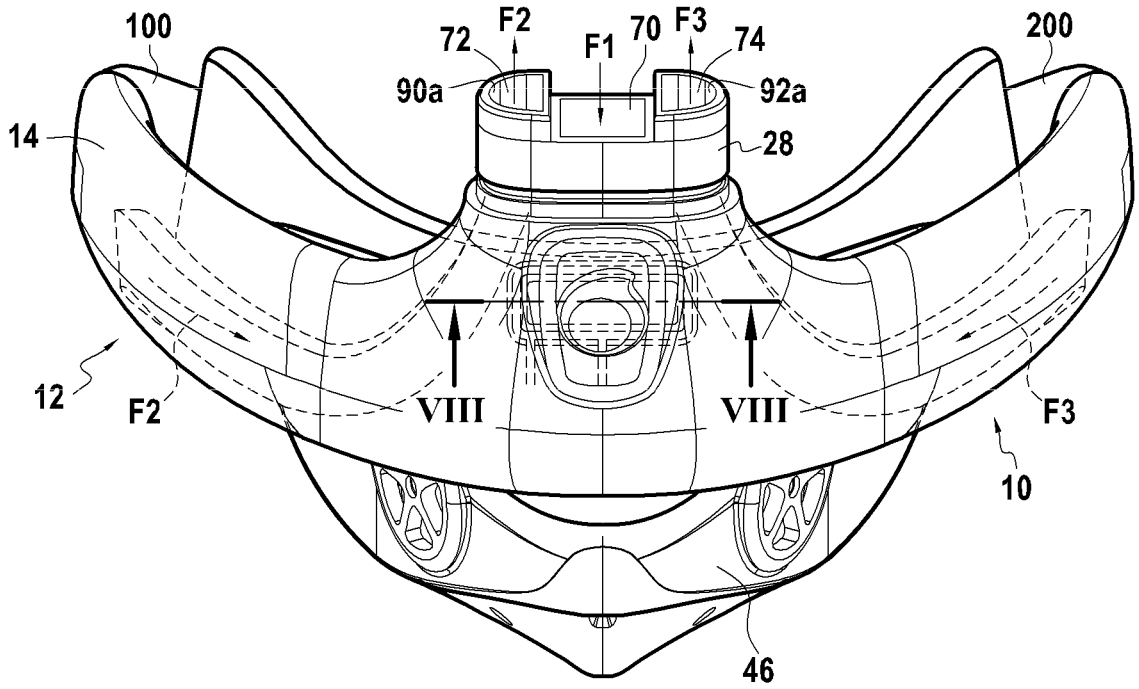
FIG. 7 is an overhead view of the flexible skirt assembled onto the frame.

As seen in FIG. 7, which illustrates an overhead view of the frame 12 assembled onto the flexible skirt 40, the extension 28 also comprises a central channel 70 arranged to communicate with the inlet channel for inhaled air 60 when the snorkel is attached to the frame, and two exhalation channels 72, 74 arranged to communicate with the first and second escape channels for exhaled air 62, 64 respectively.

Figure 8:
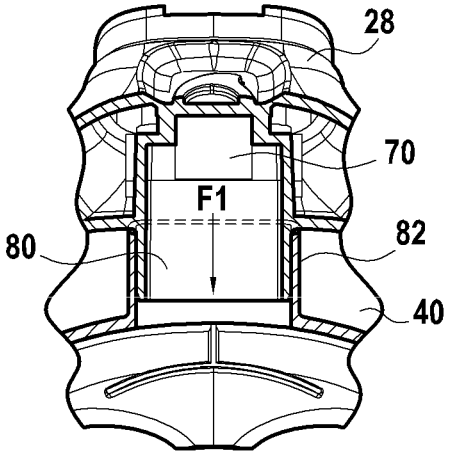
FIG. 8 is a detailed view of the connection of the top coupling sleeve of the flexible skirt with the top connector of the frame.

With reference now to FIG. 8, it can be seen that the frame 12 also comprises a top connector 80 projecting from the upper portion 14 of the frame 12. The flexible skirt 40 has a top coupling sleeve 82 projecting from an upper part of the flexible skirt 40 leading into the upper chamber 50. It can be seen that the top connector 80 engages inside the top coupling sleeve 82 to form a sealed connection between these two elements. In FIG. 8, the arrow F1 symbolises the flow of inhaled fresh air.

It will be understood that during an inhalation phase, fresh air enters the snorkel, flows along the inlet channel for inhaled air, then into the upper chamber 50 passing through the top coupling sleeve 82.

We will now turn our attention to the exhaled air circuit.

Figure 9:
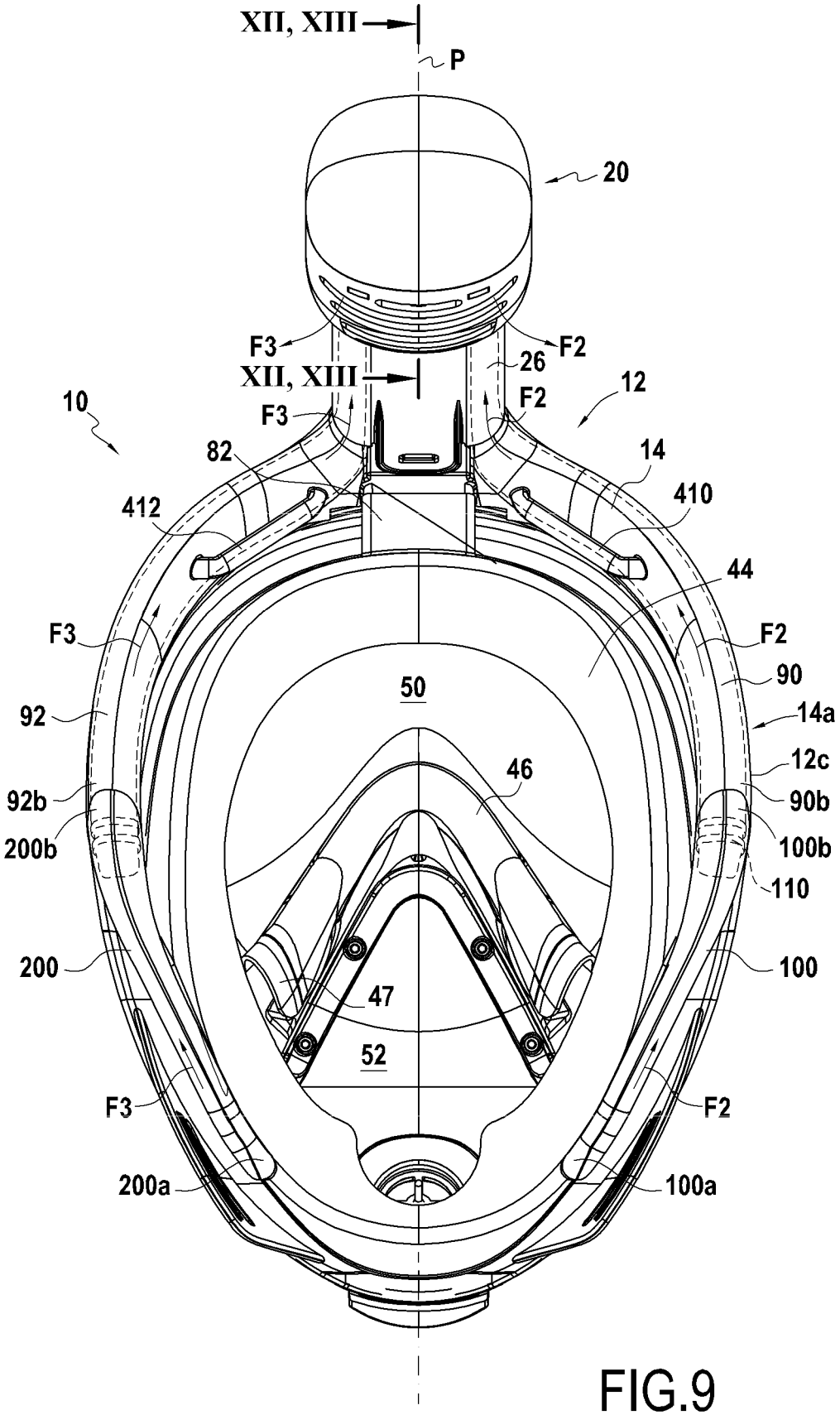
FIG. 9 is a rear view of the mask in FIG. 1, without the attaching strap.

According to the disclosure, inside the frame 12, and more specifically inside the upper part 14 of the said frame there is arranged a first inner duct 90 for exhaled air and a second inner duct 92 for exhaled air. As seen in FIG. 9, these first and second inner ducts are arranged either side of a longitudinal plane P of the mask. This plane P here forms the plane of symmetry of the mask.

Insofar as the first and second inner ducts 90, 92 are identical, a description is given solely of the first inner duct 90. This duct has an upper end 90*a* which corresponds to the outlet of the channel 72 illustrated in FIG. 7. The first inner duct 90 also has a lower end 90*b*.

In addition, according to the disclosure, the flexible skirt 40 also comprises a first coupling sleeve 100 projecting from a first side edge 41 of the flexible skirt 40 and extending towards the upper part 12*a* of the frame 12. The first coupling sleeve, which forms one and the same part with the flexible skirt, has a lower end 100*a* leading into the lower chamber 52 and an upper end 100*b*, opposite the lower end, which is in fluid communication with the lower end of the first inner duct. It will be understood that the coupling sleeve forms a duct for exhaled air.

The flexible skirt also comprises a second coupling sleeve 200, identical to the first coupling sleeve 100, the second coupling sleeve 200 projecting from a second side edge 43 of the skirt 40, opposite the first side edge. The second coupling sleeve has a lower end 200*a* leading into the lower chamber 52 and an upper end 200*b*, opposite the lower end, which is in fluid communication with the lower end 92*b* of the second inner duct 92.

With reference to FIG. 9, it can be seen that the first inner duct 90 extends between the top of the frame and a lower end 14*a* of the upper portion 14 of the frame.

Figure 10A:
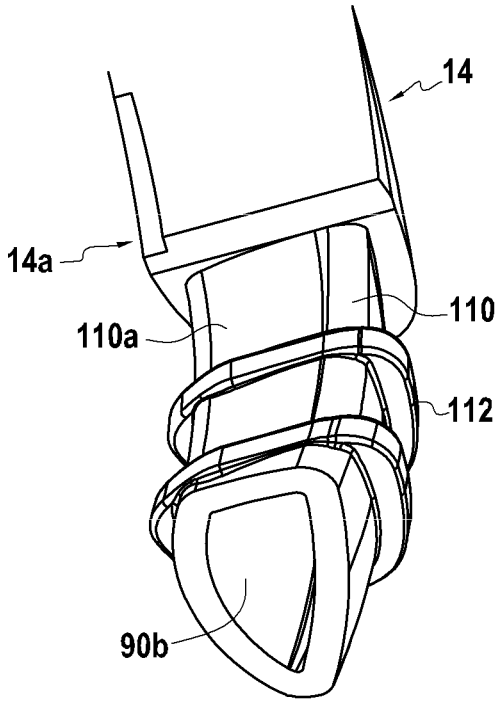
FIGS. 10A and 10B are detailed views of the connection of the first coupling sleeve of the flexible skirt with the first lateral connector of the frame.
Figure 10B:
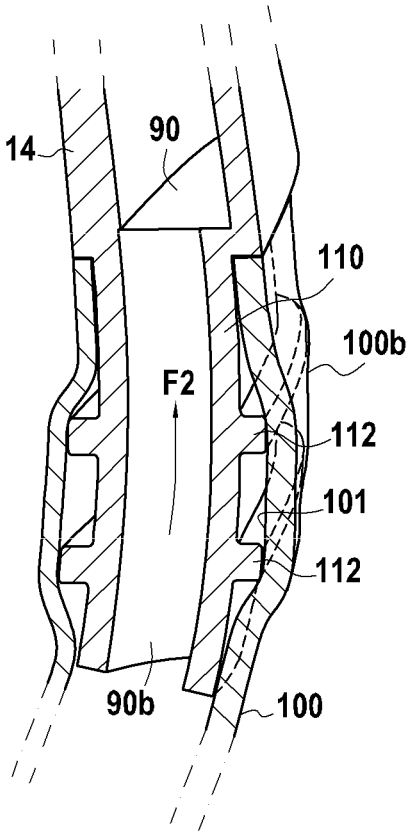

With reference to FIGS. 9, 10A and 10B, it is seen that the frame 12, and more specifically the lower end of the upper portion 14 of the frame 12, comprises a first lateral connector 110 which is engaged in the second end 100*b* of the first coupling sleeve. To improve strength and sealing, the first lateral connector 110 is provided with ribs 112 on its outer surface 110*a*, the ribs 112 cooperating with the inner surface 101 of the second end of the first coupling sleeve. Again with reference to FIG. 9, it can be seen that the second end of the first coupling sleeve lies flush with a side 12*c* of the frame 12.

It will therefore be understood that exhaled air successively flows through the first coupling sleeve 100, through the first inner duct 90 then through the first escape channel for exhaled air 62. This outflow of air is illustrated by the arrow F2. The arrow F3 illustrates the other circuit for outflowing air which flows via the second coupling sleeve 200 and the second inner duct 92.

Figure 11:
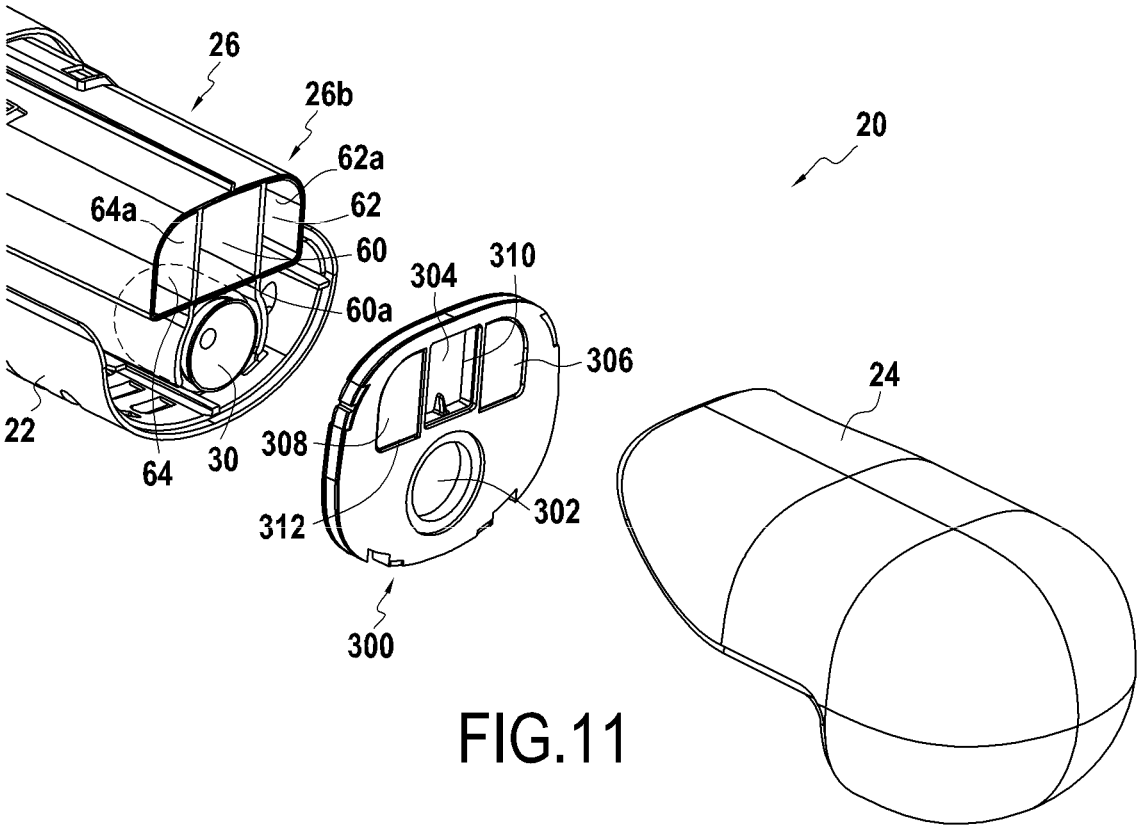
FIG. 11 is an exploded view of the upper part of the snorkel of the mask in FIG. 1.
Figure 12:
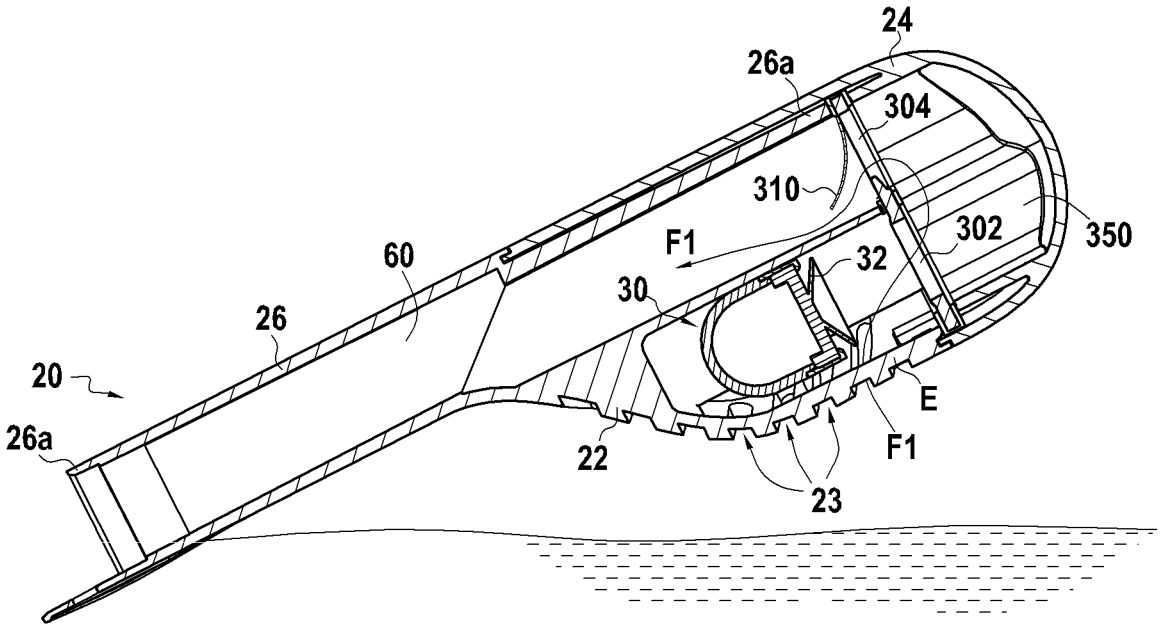
FIG. 12 illustrates the air inlet circuit into the snorkel.
Figure 13:
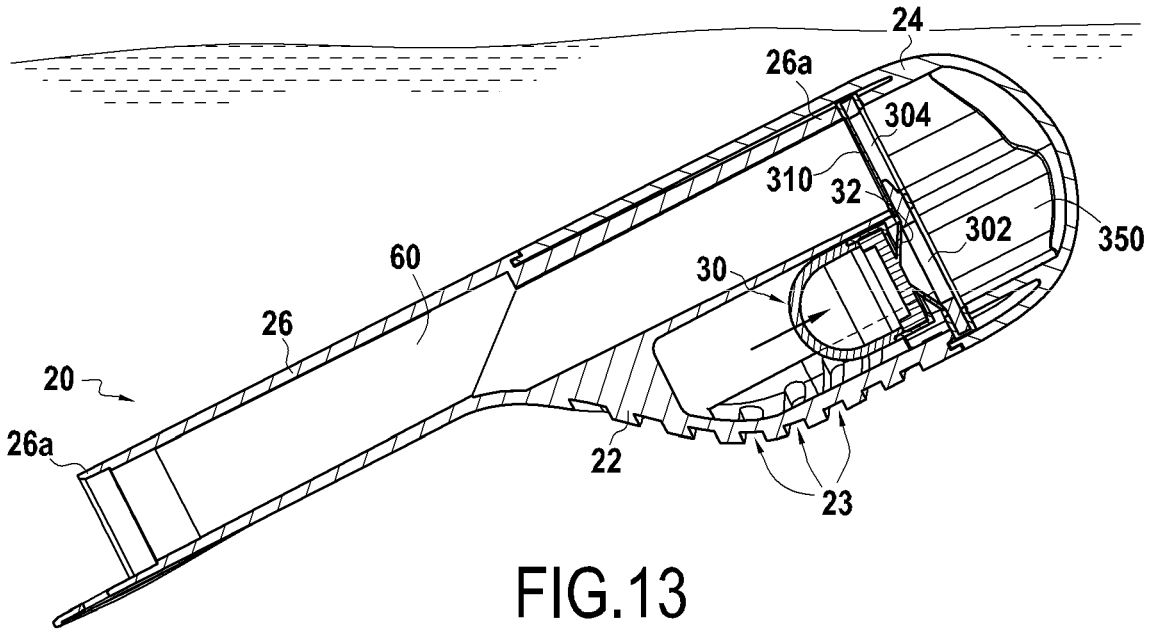
FIG. 13 shows the situation in which the float shuts off the snorkel intake when it is submerged in water.

With the help of FIGS. 11 to 13, it is the upper portion of the snorkel 20 that will now be more particularly described.

The snorkel 20 of the mask according to the disclosure and at its upper end comprises means for regulating air entering and leaving the snorkel. For this purpose, the snorkel 20 comprises a plate 300 which is sealingly arranged between the cap 24 and the upper end 26*b* of the body 26 of the snorkel 20.

This plate comprises a main orifice 302 communicating with the intake E of the snorkel. In this example, the intake E of the snorkel is formed by slits 23 arranged in the cage 22.

The plate 300 also comprises an inlet orifice 304 communicating with the inlet 60*a* of the inhaled air channel 60.

The plate 300 further comprises a first outlet orifice 306 which communicates with the outlet 62*a* of the first escape channel 62.

The plate 300 further comprises a second outlet orifice 308 which communicates with the outlet 64*a* of the second escape channel for exhaled air.

As will be understood with the help of FIG. 11, the cross-sections of the main orifice 302, of the inlet orifice 304 and of the two outlet orifices 306, 308 substantially correspond to the cross-sections of the inlet channel for inhaled air 60 and of the escape channels 62, 64 for exhaled air.

The plate 300 also comprises a first check valve 310 arranged facing the first inlet orifice 304, to shut off the said inlet orifice during an exhalation phase. The plate 300 also has a second check valve 312, arranged facing the first outlet orifice to close the said outlet orifice during an inhalation phase. And in this example the plate 300 also has a third check valve 312 arranged to close the second outlet orifice during an inhalation phase.

The snorkel 20 further comprises a fluid communication chamber 350 into which the main orifice 302, the inlet orifice 304, the first outlet orifice 306 and the second outlet orifice 308 all lead. The fluid communication chamber 350 is arranged in the cap 24 which is sealingly attached to the upper end of the body 26.

FIG. 12 illustrates the configuration of the snorkel during an inhalation phase. It will be understood that inhaled fresh air, illustrated by the arrow F1, enters the cage 22 via the slits 23 then enters the fluid communication chamber 350 via the main orifice 302 and then into the inlet channel for inhaled air 60 passing through the inlet orifice 304, the first check valve 310 being open to allow the passing of the air flow.

FIG. 13 illustrates the case in which the snorkel is submerged in the water. The float 30, under the effect of Archimedes' thrust, rises inside the cage 22 until the shut-off device 32 closes the main orifice 302, thereby closing the snorkel intake.

Figure 14:
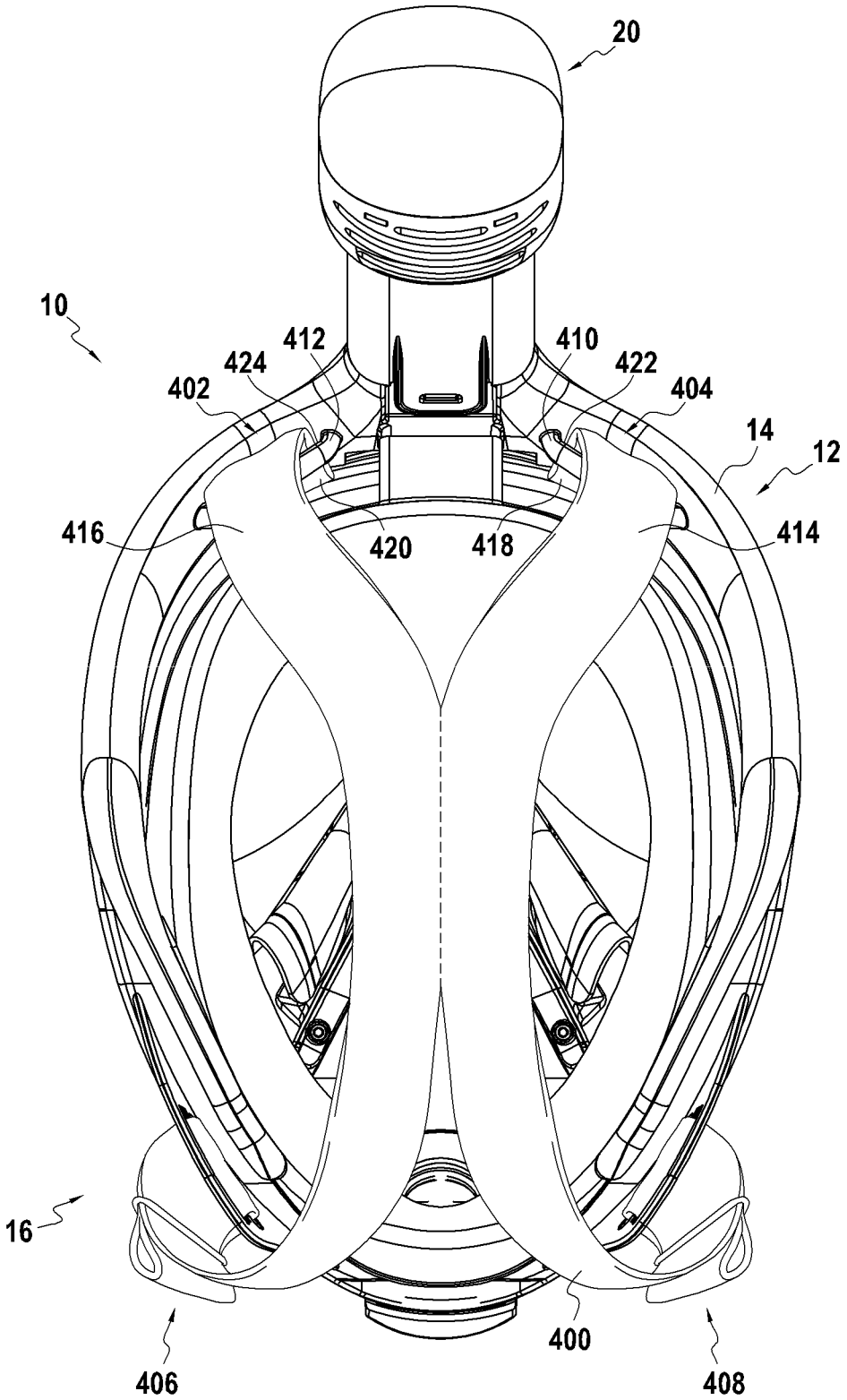
FIG. 14 is a rear view of the mask in FIG. 1, with the attaching strap.

As illustrated in FIG. 14, according to another aspect of the disclosure, the diving mask 10 further comprises a retaining elastic strap 400 extending between the upper portion 14 of the frame and the lower portion 16. The elastic strap 400 comprises two link points 402, 404 with the upper portion 14 and two link points 406, 408 with the lower portion 16. It is therefore seen that the elastic strap is X-shaped.

The upper portion 14 of the frame 12 has two loops 410, 412 through which the ends are passed of the two upper parts of the strap portions 414, 416. It can be seen that the ends of these two strap portions 414, 416 form bulges 418, 420 which are larger than the slots 422, 424 arranged in the loops, thereby ensuring the retaining of the elastic strap 400 on the frame.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

It is intended that the specification and examples be considered as exemplary only, with a true scope of the disclosure being indicated by the following claims.

The invention claimed is:

1. A water-sport mask comprising:

a rigid frame;

a faceplate surrounded by the rigid frame;

a flexible skirt mounted on the rigid frame, the flexible skirt comprising a partition delimiting an upper chamber and a lower chamber, the partition being arranged to bear upon the top of a user's nose when the water-sport mask is worn by the user so that the user's mouth and nose are positioned within the lower chamber, the partition having at least one passageway arranged to allow circulation of air from the upper chamber to the lower chamber during an inhalation phase;

a conduit having an inlet channel enabling entry of ambient air and a first escape channel enabling exit of exhaust air, the conduit extending at an upper part of the rigid frame, the inlet channel being in fluid communication with the upper chamber, and the first escape channel being in fluid communication with the lower chamber, the rigid frame comprising at least one first duct, the first duct having an upper end opening into the first escape channel, and a lower end opening into the lower chamber.

2. The water-sport mask according to claim 1, wherein the flexible skirt also comprises at least one first coupling sleeve projecting from a first side edge of the flexible skirt, said at least one first coupling sleeve being in fluid connection with said at least one first duct for exhaust air.

3. The water-sport mask according to claim 1, wherein the rigid frame comprises one or more ribs in contact with at least a portion of the flexible skirt.

4. The water-sport mask according to claim 1, wherein the rigid frame comprises an outer portion, the flexible skirt being arranged between the faceplate and the outer portion of the rigid frame.

5. The water-sport mask according to claim 4, wherein the rigid frame comprises one or more ribs, the flexible skirt being arranged between the outer portion of the rigid frame and the faceplate and in contact with at least a portion of the one or more ribs to prevent slippage of the flexible skirt.

6. The water-sport mask according to claim 1, wherein the rigid frame comprises an outer portion, a lower portion of the outer portion of the rigid frame comprising a first element and a second element which are attached to one another to form the lower portion of the outer portion of the rigid frame.

7. The water-sport mask according to claim 2, wherein the flexible skirt has a peripheral sealing lip arranged to bear against the user's face when the water-sport mask is worn by the user, said at least one first coupling sleeve flanking said peripheral sealing lip.

8. The water-sport mask according to claim 1, wherein the partition forms one and the same part with the flexible skirt.

9. The water-sport mask according to claim 1, wherein the conduit further comprises a second escape channel enabling exit of exhaust air, the second escape channel being in fluid communication with the lower chamber, the rigid frame further comprising a second duct, the second duct having an upper end opening into the second escape channel, and a lower end opening into the lower chamber.

10. The water-sport mask according to claim 9, wherein the flexible skirt also comprises a first and a second coupling sleeves projecting respectively from a first and a second side edges of the flexible skirt, said first and second coupling sleeves being in fluid connection respectively with said first and second ducts for exhaust air.

11. The water-sport mask according to claim 9, wherein the inlet channel is separated from the first and second escape channels via two longitudinal walls.

12. The water-sport mask according to claim 1, wherein the conduit has an upper part provided with an air-permeable cage, the conduit also comprising a float movable within said cage, said float being arranged such that when the conduit is submerged in the water the float is caused to move so that float closes the conduit intake.

13. The water-sport mask according to claim 12, wherein the float has an upper end provided with a shape acting as a shut-off device.

14. The water-sport mask according to claim 13, wherein the conduit further comprises a plate comprising:

a main orifice communicating with the intake of the conduit; an inlet orifice communicating with the inlet of the inlet channel;

at least one first outlet orifice communicating with the outlet of the first escape channel;

a first check valve arranged to close the inlet orifice during an exhalation phase;

a second check valve arranged to close the first outlet orifice during an inhalation phase; the conduit further comprising a fluid communication chamber configured to provide fluid communication between the main orifice, the inlet orifice and the first outlet orifice.

15. The water-sport mask according to claim 14, wherein the conduit comprises a body having a lower end and an upper end, the inlet channel and the first escape channel extending inside the body between the lower end and the upper end, and the fluid communication chamber being arranged in a cap sealingly attached to the upper end of the body.

16. The water-sport mask according to claim 1, wherein the conduit is removable or can be tilted.

17. The water-sport mask according to claim 1, wherein it further comprises an elastic retaining strap which extends between an upper portion of the rigid frame and a lower portion of the rigid frame.

18. The water-sport mask according to claim 17, wherein the elastic strap comprises at least one link point with one or other of the lower or upper portions of the rigid frame, said link point being formed by the cooperation between one folded end of the elastic strap with a slot formed in the lower or upper portion of the rigid frame.

19. The water-sport mask according to claim 18, wherein the elastic strap comprises two upper link points with the upper portion of the rigid frame, and two lower link points with the lower portion of the rigid frame.

20. The water-sport mask according to claim 1, wherein it further comprises a purge valve positioned in the lower chamber to evacuate liquid to outside the water-sport mask.

21. The water-sport mask according to claim 1, wherein the partition comprises a fold forming a lip.

22. The water-sport mask according to claim 1, wherein the passageway of the partition comprises a check valve arranged to allow circulation of ambient air directed solely from the upper chamber to the lower chamber during an inhalation phase.

23. A water-sport mask comprising:

a rigid frame;

a faceplate surrounded by the rigid frame;

a flexible skirt mounted on the rigid frame, the flexible skirt comprising a partition delimiting an upper chamber and a lower chamber, the partition being arranged to bear upon the top of a user's nose when the water-sport mask is worn by the user so that the user's mouth and nose are positioned within the lower chamber, the partition having at least one passageway arranged to allow circulation of air from the upper chamber to the lower chamber during an inhalation phase;

a conduit having an inlet channel enabling entry of ambient air and a first escape channel enabling exit of exhaust air, the conduit extending at an upper part of the rigid frame, the inlet channel being in fluid communication with the upper chamber, and the first escape channel being in fluid communication with the lower chamber via a first duct, the first duct having an upper end opening into the escape channel, and a lower end opening into the lower chamber, wherein the flexible skirt comprises a top coupling sleeve cooperating with a top connector of the rigid frame, the top connector projecting at an upper portion of the rigid frame, the top coupling sleeve projecting from an upper edge of the flexible skirt, said top coupling sleeve being in fluid communication with the upper chamber and comprising an inlet channel opening enabling ambient air to enter the upper chamber.

24. The water-sport mask according to claim 23, wherein said top connector is engaged inside the top coupling sleeve.

25. A water-sport mask comprising:

a rigid frame;

a faceplate surrounded by the rigid frame;

a flexible skirt mounted on the rigid frame, the flexible skirt comprising a partition delimiting an upper chamber and a lower chamber, the partition being arranged to bear upon the top of a user's nose when the water-sport mask is worn by the user so that the user's mouth and nose are positioned within the lower chamber, the partition having at least one passageway arranged to allow circulation of air from the upper chamber to the lower chamber during an inhalation phase;

a conduit having an inlet channel enabling entry of ambient air and a first escape channel enabling exit of exhaust air, the conduit extending at an upper part of the rigid frame, the inlet channel being in fluid communication with the upper chamber, and the first escape channel being in fluid communication with the lower chamber via a first duct, the first duct having an upper end opening into the first escape channel, and a lower end opening into the lower chamber, the first duct being at least partially surrounded by at least a portion of said rigid frame.

26. A snorkeling mask comprising: a rigid frame;

a faceplate surrounded by the rigid frame;

a flexible skirt mounted on the rigid frame, the flexible skirt comprising a partition delimiting an upper chamber and a lower chamber, the partition being arranged to bear upon the top of a user's nose when the snorkeling mask is worn by the user so that the user's mouth and nose are positioned within the lower chamber, the partition having at least one passageway arranged to allow circulation of air from the upper chamber to the lower chamber during an inhalation phase; a conduit having an inlet channel enabling entry of ambient air and a first escape channel enabling exit of exhaust air, the conduit extending at an upper part of the rigid frame, the inlet channel being in fluid communication with the upper chamber, and the first escape channel being in fluid communication with the lower chamber via a pinch resistant first duct, the pinch resistant first duct having an upper end opening into the first escape channel, and a lower end opening into the lower chamber.

27. A snorkeling mask comprising:

a rigid frame;

a faceplate surrounded by the rigid frame;

a flexible skirt mounted on the rigid frame, the flexible skirt comprising a partition delimiting an upper chamber and a lower chamber, the partition being arranged to bear upon the top of a user's nose when the snorkeling mask is worn by the user so that the user's mouth and nose are positioned within the lower chamber, the partition having at least one passageway arranged to allow circulation of air from the upper chamber to the lower chamber during an inhalation phase;

a conduit having an inlet channel enabling entry of ambient air and a first escape channel enabling exit of exhaust air, the conduit extending at an upper part of the rigid frame, the inlet channel being in fluid communication with the upper chamber, and the first escape channel being in fluid communication with the lower chamber via a first duct, the first duct having an upper end opening into the first escape channel, and a lower end opening into the lower chamber, the first duct further comprising two opposed longitudinal walls rigidly spaced from each other.

28. A snorkeling mask comprising:

a rigid frame;

a faceplate surrounded by the rigid frame;

a flexible skirt mounted on the rigid frame, the flexible skirt comprising a partition delimiting an upper chamber and a lower chamber, the partition being arranged to bear upon the top of a user's nose when the snorkeling mask is worn by the user so that the user's mouth and nose are positioned within the lower chamber, the partition having at least one passageway arranged to allow circulation of air from the upper chamber to the lower chamber during an inhalation phase; a conduit having an inlet channel enabling entry of ambient air and a first escape channel enabling exit of exhaust air, the conduit extending at an upper part of the rigid frame, the inlet channel being in fluid communication with the upper chamber, and the first escape channel being in fluid communication with the lower chamber via a first duct, the first duct having an upper end opening into the first escape channel, and a lower end opening into the lower chamber, the flexible skirt comprising a peripheral sealing lip arranged to bear against the user's face when the snorkeling mask is worn by the user, said first duct being arranged around the outer edge of the peripheral sealing lip.

* * * * *